US008164449B2

(12) United States Patent
Van Tassel

(10) Patent No.: US 8,164,449 B2
(45) Date of Patent: Apr. 24, 2012

(54) CLIP ALARM

(76) Inventor: David Van Tassel, New York, NY (US)

( * ) Notice: Subject to any disclaimer, the term of this patent is extended or adjusted under 35 U.S.C. 154(b) by 472 days.

(21) Appl. No.: 12/450,337

(22) PCT Filed: Feb. 26, 2008

(86) PCT No.: PCT/US2008/002447

§ 371 (c)(1),
(2), (4) Date: Sep. 22, 2009

(87) PCT Pub. No.: WO2008/115336

PCT Pub. Date: Sep. 25, 2008

(65) Prior Publication Data

US 2010/0097217 A1 Apr. 22, 2010

(51) Int. Cl.
*G08B 13/14* (2006.01)

(52) U.S. Cl. ..... 340/568.1; 340/572.1; 340/541; 340/571

(58) Field of Classification Search ..... 340/568.1, 340/572.1–572.9, 541, 565–566, 571, 545.1, 340/546

See application file for complete search history.

(56) References Cited

U.S. PATENT DOCUMENTS

| | | | | |
|---|---|---|---|---|
| 4,090,183 | A | 5/1978 | Miller | |
| 4,101,873 | A | 7/1978 | Anderson et al. | |
| 4,812,811 | A | 3/1989 | Asbrink et al. | |
| 4,835,523 | A | 5/1989 | Pruett | |
| 4,837,559 | A | 6/1989 | Green, Sr. | |
| 4,881,063 | A * | 11/1989 | Fawcett | 340/693.7 |
| 5,312,029 | A * | 5/1994 | Tuber | 224/679 |
| 5,319,349 | A | 6/1994 | Smith, III | |
| 5,359,755 | A * | 11/1994 | Dalton et al. | 24/515 |
| 5,508,682 | A | 4/1996 | Wachsman | |
| 5,629,677 | A | 5/1997 | Staino, Jr. | |
| 5,796,337 | A * | 8/1998 | Wachsman | 340/568.8 |
| 6,118,380 | A * | 9/2000 | Gannon | 340/573.4 |
| 6,176,455 | B1 * | 1/2001 | Ma | 248/101 |
| D452,829 | S | 1/2002 | Liles | |
| 2006/0267761 | A1 | 11/2006 | Bergman | |

FOREIGN PATENT DOCUMENTS

| | | |
|---|---|---|
| GB | 2236000 | 3/1991 |
| KR | 1020060017665 | 2/2006 |

* cited by examiner

*Primary Examiner* — Daniel Previl
(74) *Attorney, Agent, or Firm* — Richard C. Litman

(57) ABSTRACT

The clip alarm (100) is a retaining clip attachable to personal items in order to function as a loss prevention device capable of emitting an audible and/or visual alarm in response to the clip and attached item being dislodged from a user's person. Upon dislodgment from a person or other support, a top clip member (105) of the device is pivoted towards an opposing, bottom clip member (110) through spring tensioning to make electrical contact with a battery (118) powering the alarm. The bottom surface of the bottom clip member (110) may have a permanently attached hook and loop fastener (200) to enable attachment of the clip to an item having a complementary hook and loop fastener. A recessed switch (120) is provided to turn the unit off when the user desires to intentionally remove it from his/her person or other object.

8 Claims, 5 Drawing Sheets

CLIP ALARM

TECHNICAL FIELD

The present invention relates to alarm devices, and more particularly to a clip alarm for alerting a person when a personal item has become separated from clothing or a support to which the item is clipped.

BACKGROUND ART

Personal items, such as glasses, cell phones, PDAs, digital cameras, and the like, are increasingly used and carried by individuals from place to place. Some of these items may or may not have a retaining clip that can be clipped on to a user's person or other object to reduce the risk of loss.

While such a retaining clip may be helpful, loss of the aforementioned personal items remains a common occurrence. For example, on a subway or a crowded street with huge crowds of people in close proximity to each other, the retaining clip attached to a user may easily be dislodged from the user, who may not be immediately aware of this loss, during various movements of the user and those around the user. Many of the aforementioned devices are also attractive to thieves, who may be able to unclip and remove the devices without the owner being aware of the occurrence.

More effective measures for reducing the risk of losing these personal items by inadvertent dislodgment or surreptitious theft would be highly beneficial to the owners of such devices. Thus, a clip alarm solving the aforementioned problems is desired.

DISCLOSURE OF INVENTION

The clip alarm is a retaining clip, which is attachable to portable/personal items in order to function as a loss prevention device, and is capable of emitting an audible and/or visual alarm in response to the clip and attached personal item being dislodged from a user's person. Upon dislodgment from a person or other support, a top clip member of the device is pivoted towards an opposing, bottom clip member through spring tensioning to make electrical contact with a battery powering the alarm. The bottom surface of the bottom clip member may have a permanently attached hook and loop fastening system to enable secure fastening of the clip to an item having a complementary hook and loop fastening system. A recessed switch is provided to turn the unit off when the user desires to intentionally remove it from his/her person or other supporting object.

These and other features of the present invention will become readily apparent upon further review of the following specification and drawings.

BRIEF DESCRIPTION OF THE DRAWINGS

Similar reference characters denote corresponding features consistently throughout the attached drawings.

BEST MODES FOR CARRYING OUT THE INVENTION

The present invention is a retaining clip, which is attachable to portable/personal items in order to function as a loss prevention device capable of emitting an audible and/or visual alarm in response to the clip and attached item being dislodged from a user's person. Upon dislodgment from a person or other support to which the item is clipped, a top clip member of the device is pivoted towards an opposing bottom clip member through spring tensioning to make electrical contact with a battery powering the alarm. The bottom surface of the bottom clip member may have a permanently attached hook and loop fastening system to enable secure fastening of the clip to an item having a complementary hook and loop fastening system. A recessed switch is provided to turn the unit off when the user desires to intentionally remove it from his/her person or other object.

Figure 1A:
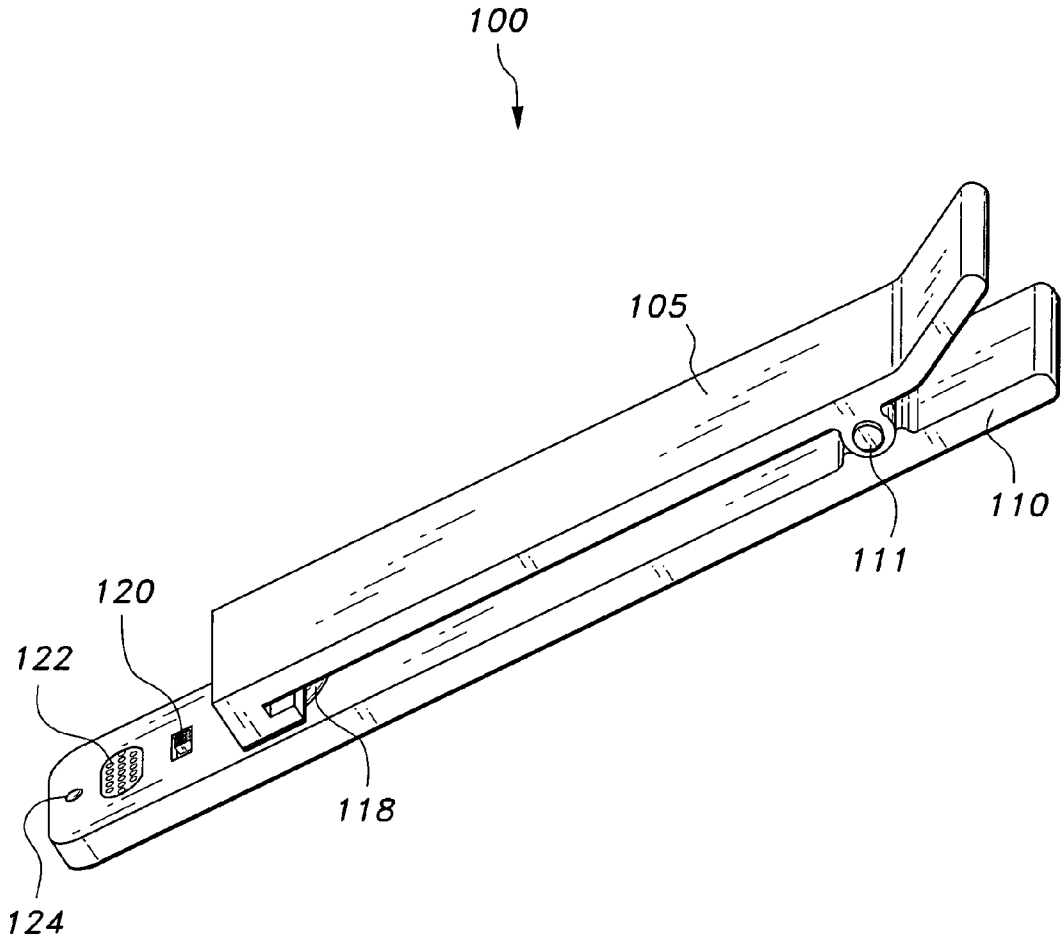
FIG. 1A is a perspective view of a clip alarm according to the present invention, shown in a closed position.
Figure 1B:
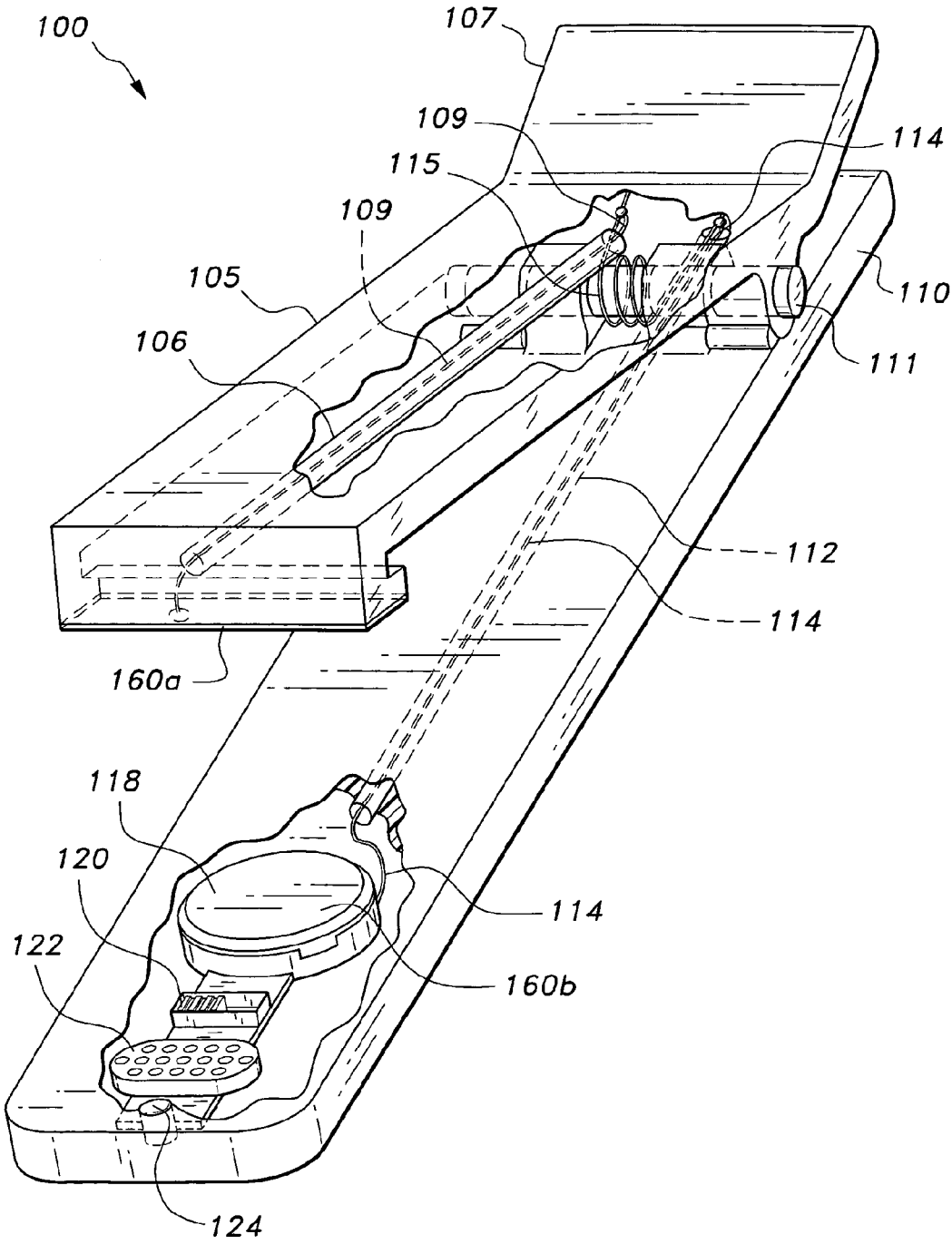
FIG. 1B is a perspective view of a clip alarm according to the present invention, broken away and partially in section to show details thereof, the clip being shown in an open position.
Figure 3:
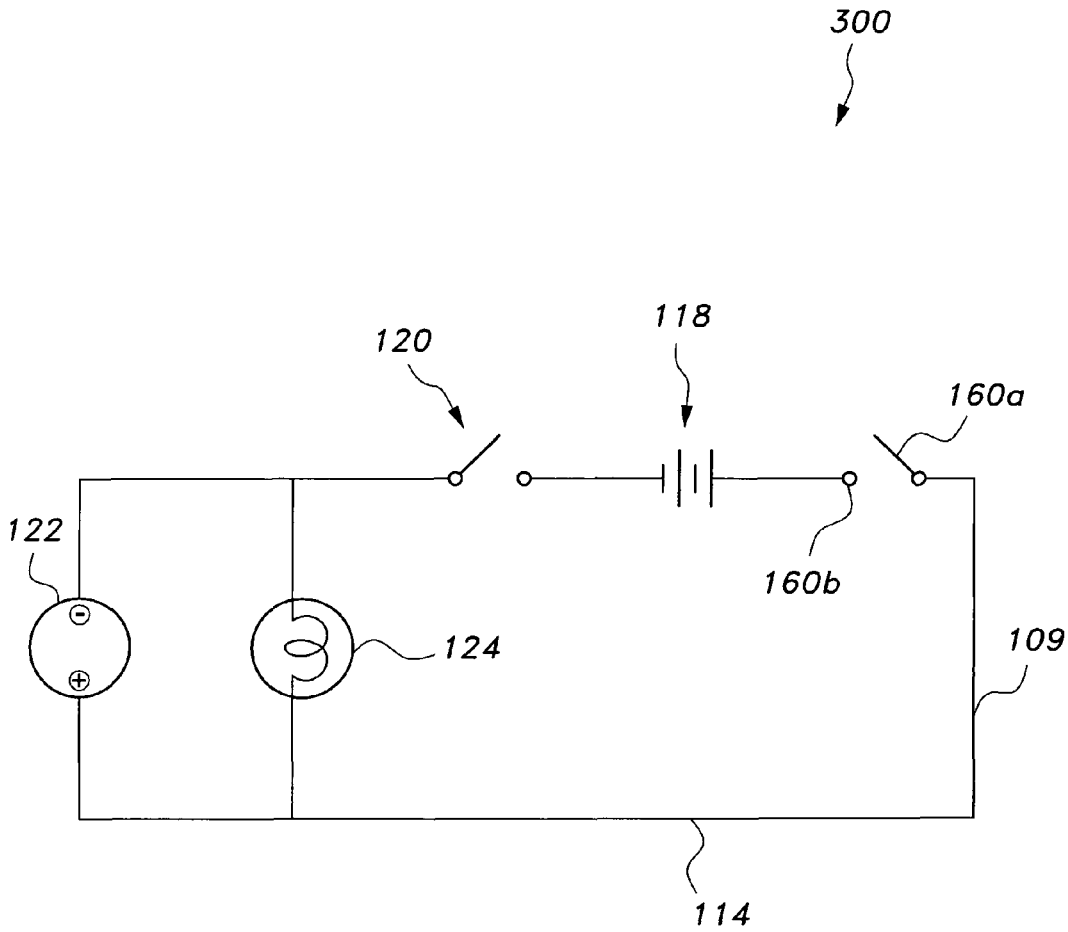
FIG. 3 is a schematic diagram of the clip alarm according to the present invention.

Referring to FIGS. 1A, 1B, and 3, the clip alarm 100 is a retaining clip having a substantially elongated top retaining clip member 105 and a similar, substantially elongated bottom retaining clip member 110. A thumb press 107 is disposed near an upper end of the top member 105. An electrical contact 160*a* is disposed on a lower end of the top member 105. A battery 118 is disposed in the bottom member 110. The battery 118 has a battery electrode that can be exposed, extending upward from or, flush with an upper surface of the bottom member 110. Alternatively, the battery 118 may have a battery electrode that is in contact with an electrically conductive cap or other electrical contact extending upward from, or flush with, an upper surface of the bottom member 110.

An electrically operated alarm circuit 300 includes a buzzer 122 and/or a lamp 124, which electrically connect to each other, preferably in parallel. The buzzer 122 and the lamp 124 are disposed in the lower end of the bottom member 110. A preferably recessed cutoff switch 120 is disposed in the lower end of bottom member 110. The cutoff switch 120 is capable of interrupting current flow between the buzzer 122 and light 124 portion of alarm 300 and the battery 118 so that a user can remove the clip from his/her person without triggering the alarm circuit 300.

The top 105 and bottom 110 retaining clip members are pivotally attached to each other at their upper ends via pivot pin 111. An electrically conducting coil spring 115, such as a torsion spring, is insulated from and disposed around the pivot pin 111 to bias the top 105 and bottom 110 retaining clip members to a closed position. Absent a force applied to the thumb press 107, or the placement of an intervening non-conducting material, such as a user's shirt pocket, between contact 160*a* and electrode connection 160*b*, the closing bias keeps the contact 160*a* in physical and electrical contact with the battery electrode connection 160*b*.

A wire 109 or other electrically conductive medium is disposed in a passageway 106 in the top retaining clip member 105. The passageway extends towards the lower end of top retaining clip member 105 to enable electrical connection of the wire 109 to the electrical contact 160*a*. The passageway extends towards the upper end of top retaining clip member 105 to enable electrical connection of the wire 109 to the coil spring 115 in a region of the spring 115 that is in physical proximity to the top retaining clip member 105.

Similarly, a return wire 114 or other electrically conductive medium is disposed in a passageway 112 of the bottom retaining clip member 110. The passageway 112 extends towards the lower end of bottom retaining clip member 110 to enable electrical connection of the return wire 114 to the buzzer 122 and/or light 124 of alarm circuit 300. The passageway 112 extends towards the upper end of bottom retaining clip member 110 to enable electrical connection of the wire 114 to the coil spring 115 in a region of the spring 115 that is in physical proximity to the bottom retaining clip member 110.

Figure 2:
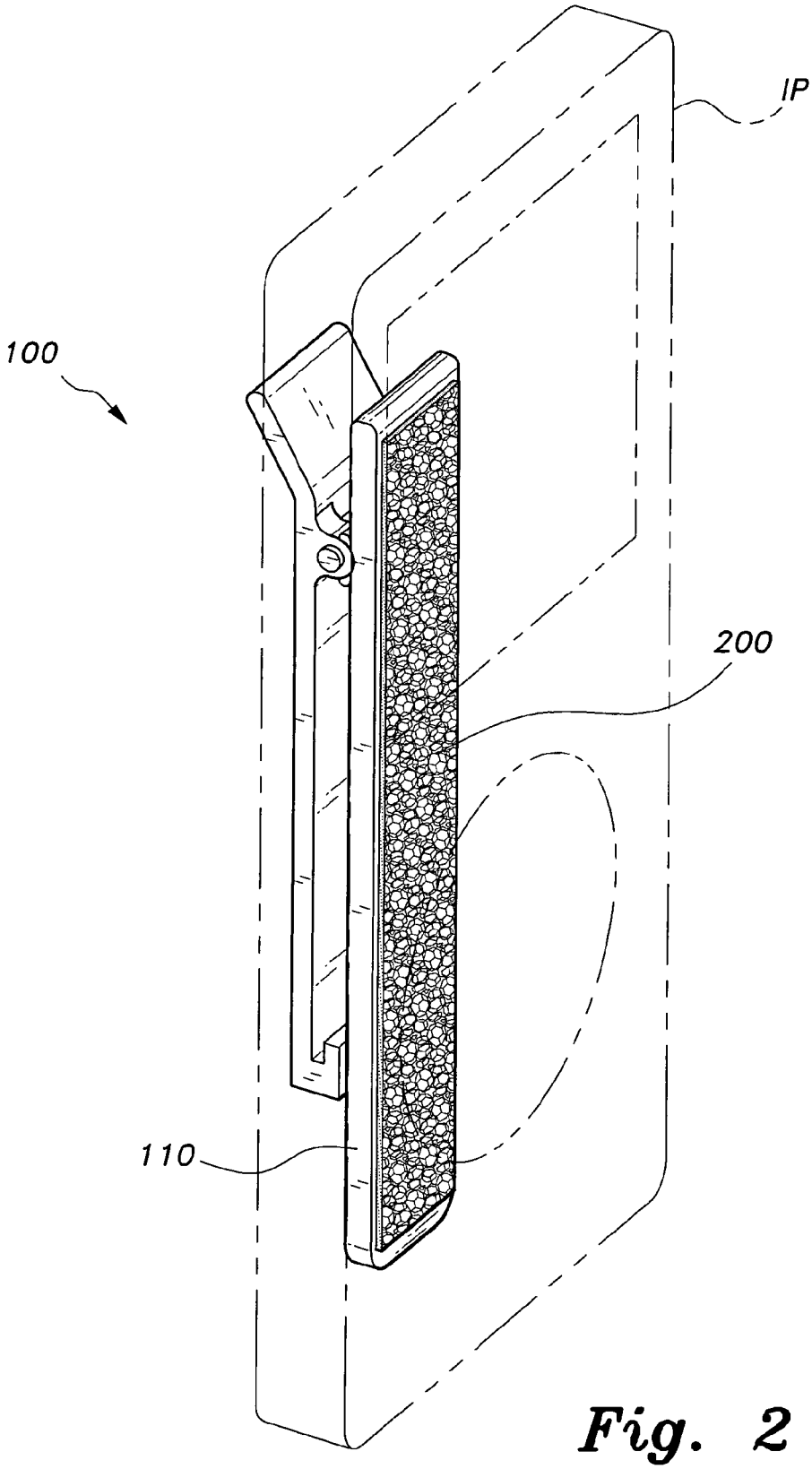
FIG. 2 is an environmental perspective view of the clip alarm according to the present invention shown with an attached personal item.

As shown in FIG. 2, an attachment pad 200 of hook and loop fastening material, or, alternatively, an adhesive attachment pad, is disposed along the bottom surface of bottom retaining clip member 110. A personal item IP can be attached to the alarm clip 100 via attachment pad 200. When the item IP is attached to the alarm clip 100, and the alarm clip 100 is clipped to a user's shirt pocket, belt, purse, or other object, the contact 160*a* and battery electrode connection 160*b* are physically and electrically separated so that the alarm will not sound. If the personal item IP and clip 100 are dislodged from the user's person or other object, the contact 160*a* and battery electrode connection 160*b* pivot into physical and electrical contact to activate the alarm, thereby alerting the user.

Figure 1C:
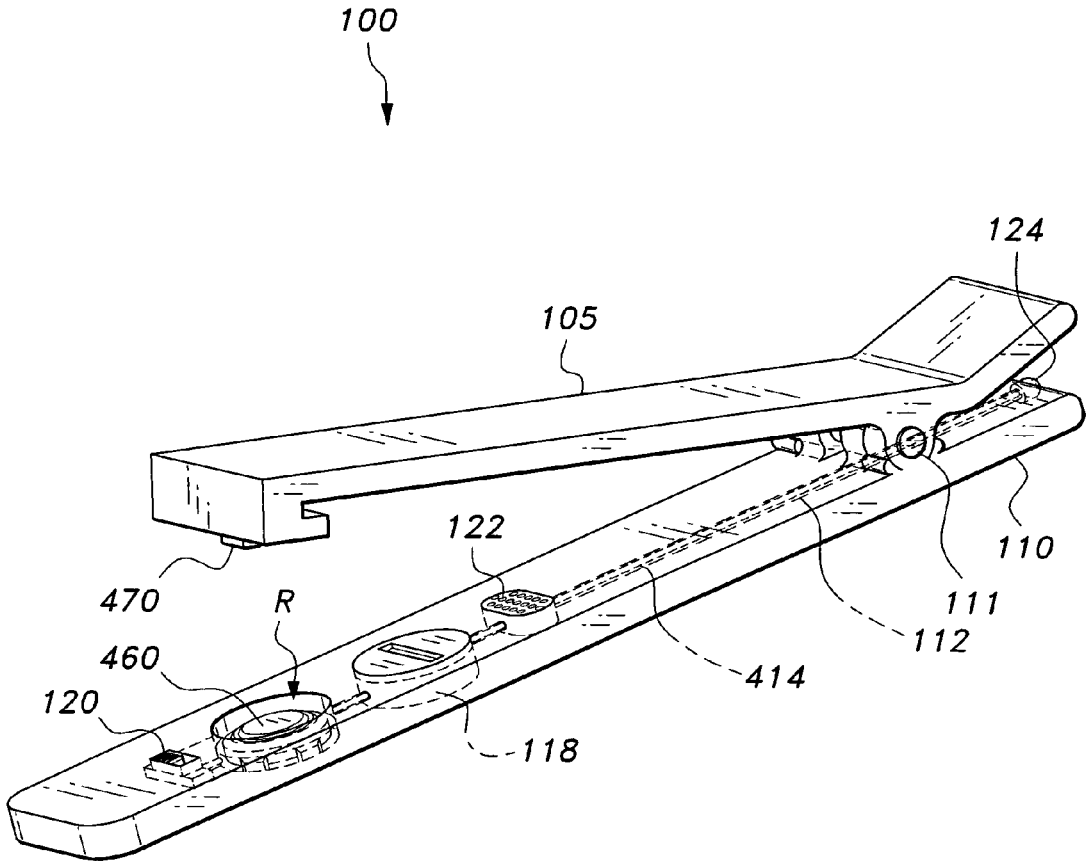
FIG. 1C is a perspective view of an alternative embodiment of the clip alarm according to the present invention, broken away and partially in section to show details thereof, the clip being shown in an open position.

In an alternative embodiment, shown in FIG. 1C, a single, normally open momentary tact switch 460 may be disposed in a recess R of a medial portion of the retaining clip member 110. A raised pin 470 may project from the top clip member 105. Spring biasing of the clip members 105, 110 causes the raised pin 470 to bear against the medial portion of clip member 110, the raised pin 470 being aligned to engage switch 460, closing the switch contacts and forming an electrically closed circuit.

As shown in FIG. 1C, the power source 118 and the alarm transducer 122 are disposed in the electrically closed circuit within the bottom clip member 110. In this embodiment, warning lamp 124 is disposed on a top portion of bottom member 110. Lamp conduction wires 414 extend from buzzer 122 along channel 112 and are connected to lamp 124 to energize the lamp when buzzer 122 is activated. When the clip 100 is attached to a support structure, such as a user's clothing, belt, or the like, the raised pin 470 is separated from mechanical contact with the momentary switch 460. When the clip 100 is removed from the support structure, the spring bias forces mechanical contact of the raised pin 470 with switch 460 to activate the alarm.

It is to be understood that the present invention is not limited to the embodiment described above, but encompasses any and all embodiments within the scope of the following claims.

The invention claimed is:

1. A clip alarm, comprising:

first and second elongated clip members pivotally attached to each other;

means for biasing the clip members in a closed position, the first clip member having a contact end bearing against a medial portion of an opposing face of the second clip member in the closed position;

a first electrical contact disposed in the contact and of the first clip member, a second electrical contact disposed in the medial portion of the opposing face of the second clip member, and an electrically conductive path extending through the first and second clip members, the electrically conductive path forming an electrically closed circuit when the first and second clip members are in the closed position;

a power source and an alarm transducer housed in the second clip member and disposed in the electrically conductive path; and means for attaching an item to the second clip member for storage and transport;

wherein the alarm transducer is turned off when the first and second clip members are clipped to an insulated support; and wherein the alarm transducer is turned on when the clip is removed from the insulated support and biased to the closed position in order to alert a user that the item has been removed from the support.

2. The clip alarm, according to claim 1, further comprising a recessed electrical cutoff switch disposed in a lower end of the second clip member, the cutoff switch interrupting current flow to the alarm transducer so that users can remove the clip from the person without triggering the alarm.

3. The clip alarm, according to claim 1, further comprising a thumb press disposed near an upper end of the first clip member, the thumb press pivoting the clip members to an open position when the thumb press is pressed by a user.

4. The clip alarm, according to claim 1, further comprising a warning lamp visibly disposed on a clip member, the warning lamp being energized when the alarm transducer is activated.

5. A clip alarm, comprising:

first and second elongated clip members pivotally attached to each other;

means for biasing the clip members in a closed position, the first clip member having a raised pin bearing against a medial portion of an opposing face of the second clip member in the closed position;

a normally open momentary electrical switch recessed in the medial portion of the opposing face of the second clip member;

an electrically conductive path extending through the first and second clip members between the raised pin and the switch, the electrically conductive path forming an electrically closed circuit when the first and second clip members are in the closed position, the raised pin mechanically engaging the normally open, momentary electrical switch, forming an electrically closed circuit;

a power source and an alarm transducer housed in the second clip member and disposed in the electrically closed circuit;

means for attaching an item to the second clip member for storage and transport;

wherein the alarm transducer is turned off when the first and second clip members are clipped to an insulated support; and wherein the alarm transducer is turned on when the clip is removed from the insulated support and biased to the closed position in order to alert a user that the item has been removed from the support.

6. The clip alarm, according to claim 5, further comprising a recessed electrical cutoff switch disposed in a lower end of the second clip member, the cutoff switch interrupting current flow to the alarm transducer so that users can remove the clip from the person without triggering the alarm.

7. The clip alarm, according to claim 5, further comprising a thumb press disposed near an upper end of the first clip member, the thumb press pivoting the clip members to an open position when the thumb press is pressed by a user.

8. The clip alarm, according to claim 5, further comprising a warning lamp visibly disposed on a clip member, the warning lamp being energized when the alarm transducer is activated.

* * * * *